US009508302B2

(12) United States Patent
Chae

(10) Patent No.: US 9,508,302 B2
(45) Date of Patent: Nov. 29, 2016

(54) APPARATUS TO SUPPLY POWER IN DISPLAY DEVICE

(71) Applicant: Samsung Display Co., Ltd., Yongin (KR)

(72) Inventor: Se-Byung Chae, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 160 days.

(21) Appl. No.: 14/140,146

(22) Filed: Dec. 24, 2013

(65) Prior Publication Data

US 2014/0347343 A1 Nov. 27, 2014

(30) Foreign Application Priority Data

May 22, 2013 (KR) ..... 10-2013-0057810

(51) Int. Cl.
*G09G 3/36* (2006.01)

(52) U.S. Cl.
CPC ..... *G09G 3/3696* (2013.01)

(58) Field of Classification Search
CPC ..... G06F 1/26; G06F 1/266; G06F 1/263; G06F 1/3203; G06F 1/3287; G06F 1/30; G06F 1/28; G06F 1/3296; G06F 1/3206; G06F 1/20; G06F 1/32; G06F 1/3284; G06F 1/188; G06F 1/206; G06F 1/324; G06F 1/3234; G06F 1/189; G06F 1/3275
USPC ..... 345/212
See application file for complete search history.

(56) References Cited

U.S. PATENT DOCUMENTS 6,844,839 B2 * 1/2005 Lee et al. ..... 341/144
7,576,674 B2 * 8/2009 Tsuchi ..... G09G 3/3685 341/138
2003/0053321 A1 * 3/2003 Ishiyama ..... 363/59
2004/0160436 A1 * 8/2004 Tanaka ..... G09G 3/3696 345/211
2010/0220095 A1 * 9/2010 Chiu ..... G09G 3/3688 345/214
2012/0127151 A1 * 5/2012 Murakami ..... G09G 3/3611 345/212
2013/0271446 A1 * 10/2013 Zheng ..... G09G 3/3696 345/212
2014/0192095 A1 * 7/2014 Liao ..... G09G 3/3688 345/690

FOREIGN PATENT DOCUMENTS

JP 2011-142643 7/2011
KR 10-2000-0012003 2/2010

* cited by examiner

*Primary Examiner* — Andrew Sasinowski
*Assistant Examiner* — Chineyere Wills-Burns
(74) *Attorney, Agent, or Firm* — H.C. Park & Associates, PLC

(57) ABSTRACT

Exemplary embodiments of the present invention relate to a power supply of a display device that includes a driving circuit and a display panel that displays an image according to an output data voltage transmitted from the driving circuit. The power supply includes a first booster and a second booster provided in the driving circuit, the first booster generates a first output voltage supplied to an Op-amp of a source output circuit of the driving circuit, and the second booster generates a second output voltage supplied to buffers of the source output circuit of the driving circuit.

18 Claims, 5 Drawing Sheets

APPARATUS TO SUPPLY POWER IN DISPLAY DEVICE

CROSS-REFERENCE TO RELATED APPLICATION

This application claims priority to and the benefit of Korean Patent Application No. 10-2013-0057810, filed in the Korean Intellectual Property Office on May 22, 2013, the entire contents of which are incorporated herein by reference.

BACKGROUND

Field

Embodiments of the present invention relate to a power supply of a display device. More particularly, the present invention relates to a device for supplying power to a driving circuit of a display device.

Description of the Related Art

In general, a display device displaying a high resolution image additionally uses an external DCDC converter circuit to generate a primary booster voltage (i.e., a source-end voltage of a driving circuit in the display device) due to high power consumption of the driving circuit.

The primary booster voltage used as the source-end voltage of the high-resolution display device uses an external power supply circuit so that production cost is increased and flexibility in a set design of the display device is decreased.

The reason that the external power supply circuit cannot be installed in the driving circuit is that the primary booster consumes excessive power.

That is, when power is supplied to the embedded power supply of the high-resolution display device, the primary booster output voltage efficiency becomes lower than an allowable range, thereby causing a problem in outputting a desired output.

Therefore, a conventional method of using an external power supply circuit for power supply to a driving circuit of a display device should be improved, and a design of a power supply circuit that can disperse power supply for effective power supply is required.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention provide a power supply including an embedded power supply circuit designed to be able to disperse power consumed by a driving circuit of a display device without deteriorating output voltage efficiency.

An exemplary embodiment of the present invention discloses a power supply of a display device that includes a driving circuit and a display panel configured to display an image according to an output data voltage transmitted from the driving circuit. The power supply comprises a first booster and a second booster disposed in the driving circuit. The first booster is configured to generate a first output voltage that is supplied to an Op-amp of a source output circuit of the driving circuit, and the second booster is configured to generate a second output voltage that is supplied to a buffer of the source output circuit of the driving circuit.

Another exemplary embodiment of the present invention discloses an apparatus including a power supply circuit and a driving circuit. The power supply circuit includes a first circuit configured to receive a first voltage and output a second voltage, and a second circuit configured to receive a third voltage and output a fourth voltage different from the second voltage. The driving circuit includes a first part configured to receive the second voltage and a second part configured to receive the fourth voltage. The power supply circuit and the driving circuit are integrally formed.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION

Figure 1:
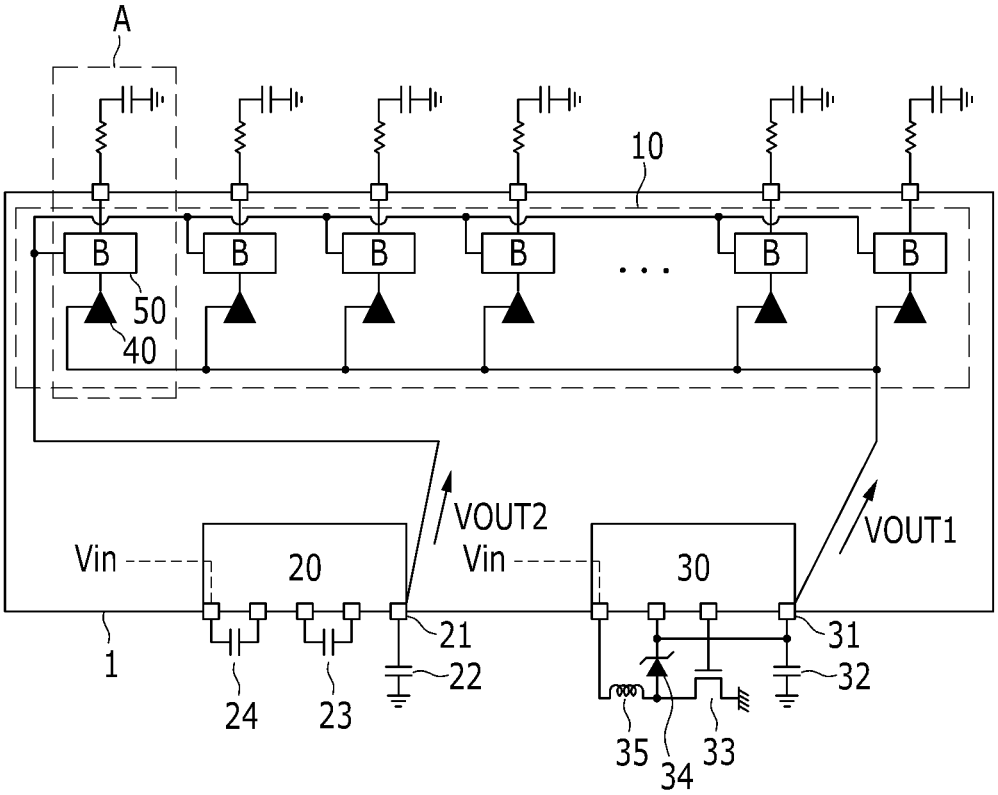
FIG. 1 shows a power supply in a driving circuit of a display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention.

Accordingly, the drawings and description are to be regarded as illustrative in nature and not restrictive Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

In general, a display device including a display panel having high resolution consumes excessive power in a driving circuit. Thus, such a high-resolution display device additionally includes an external DC-to-DC IC for generating a primary booster end voltage is supplied to a source output circuit, that is, a source end voltage. A primary booster generation voltage used in the source output circuit of the driving circuit of the display device is supplied using a DC-to-DC converter, which is an external power supply. Such an addition of the external DC-to-DC circuit causes increase of production cost of the display device and also causes limitation in various modification of a set design.

However, when a power supply is installed in the driving circuit of the display device, an output voltage efficiency of the primary booster may be significantly deteriorated due to excessive power consumption of the primary booster, and accordingly high-resolution output may not be provided.

For example, a source output circuit of a typical FHD display device consumes 190 mW to 200 mW, and therefore an output voltage consumed by such a source output circuit may not be stably supplied.

Hence, the display device according to the exemplary embodiment of the present invention is provided with a power supply in a driving circuit as shown in FIG. 1, but the power supply is dispersed. Referring to FIG. 1, a driving circuit 1 of the display device according to the exemplary embodiment of the present invention includes a power supply provided in the driving circuit 1 and a source output circuit 10.

The power supply includes a capacitive booster 20 and an inductive booster 30. As a power supply, the capacitive booster 20 and the inductive booster 30 respectively generate power and supply the power to the source output circuit 10.

The source output circuit 10 is formed of an amplification circuit (Op-amp) and an output buffer.

Although it is not illustrated in detail in the source output circuit 10 of FIG. 1, the amplification circuit generally refers a plurality of Op-amps 40 in the source output circuit 10 and the output buffer generally refers to a plurality of buffers 50 in the source output circuit 10.

Each Op-amp 40 in the amplification circuit outputs a gray voltage selected according to an input image data signal received within the entire grayscale range as a stable voltage.

In addition, each buffer 50 of the output buffer outputs a voltage corresponding to a current that substantially drives the display panel with an output voltage value of the Op-amp 40 of the amplification circuit.

The plurality of Op-amps 40 of the amplification circuit are electrically connected with each other and receive a voltage output from the power supply.

Likewise, the plurality of buffers 50 of the output buffer are connected with each other and receive an output voltage of the power supply that is different from the voltage supplied to the amplification circuit.

That is, in the exemplary embodiment of FIG. 1, the inductive booster 30 of the power supply generates a first output voltage VOUT1 and transmits the first output voltage VOUT1 to the plurality of Op-amps 40 of the amplification circuit. In addition, the capacitive booster 20 of the power supply generates a second output voltage VOUT2 and transmits the second output voltage VOUT2 to the plurality of buffers 50.

In the exemplary embodiment of FIG. 1, Power consumption may be changed depending on a data load capability with reference to a high resolution display device, but when power consumption of the amplification circuit is higher than that of the output buffer, since an output voltage efficiency of the inductive booster 30 is higher than that of the capacitive booster 20, the first output voltage VOUT1 transmitted to the amplification circuit may be higher than the second output voltage VOUT2 transmitted to the output buffer.

In further detail, in the exemplary embodiment of FIG. 1, the inductive booster 30 may include an inductor 35, a diode 34, a switching transistor 33, and an output terminal capacitor 32. In FIG. 1, the switching transistor 33 is shown as an NMOS transistor but it is not restrictive. Furthermore, although diode 34 is shown as a zener diode, other types of diodes may be used. The switching transistor 33 may enable output of the output voltage VOUT1 by being closed/opened according to a switching operation signal input to a gate terminal thereof. That is, as the switching transistor 33 is turned off, a current supplied through the inductor 35 is stored in the output terminal capacitor 32 via the diode 34. In addition, the output voltage VOUT1 is provided via the output terminal 31 in part, using the output terminal capacitor 32, and may then be supplied to the amplification circuit.

In the exemplary embodiment of FIG. 1, the capacitive booster 20 may include two booster capacitors, that is, a first booster capacitor 23 and a second booster capacitor 24, and an output terminal capacitor 22. In FIG. 1, the output voltage VOUT2 boosted by the first and second booster capacitors 23 and 24 is supplied to the output buffer via the output terminal 21 in part, using the output terminal capacitor 22.

The configuration of the inductive booster 30 and the capacitor booster 20 according to the exemplary embodiment of FIG. 1 are not restrictive.

As an exemplary embodiment, since an output voltage efficiency of the inductive booster 30 is higher than that of the capacitive booster 20, the output voltage consumption can be effectively realized by connecting the inductive booster 30 to a circuit having higher power consumption between the amplification circuit and the output buffer.

When supplying power, the power supply according to the exemplary embodiment of the present invention divides power consumed in the source output circuit into the amplification circuit and the output buffer, and therefore power consumption is dispersed so that the power can be efficiently supplied with an allowable range of voltage efficiency although the power supply is installed in the driving circuit as shown in FIG. 1.

Figure 2:
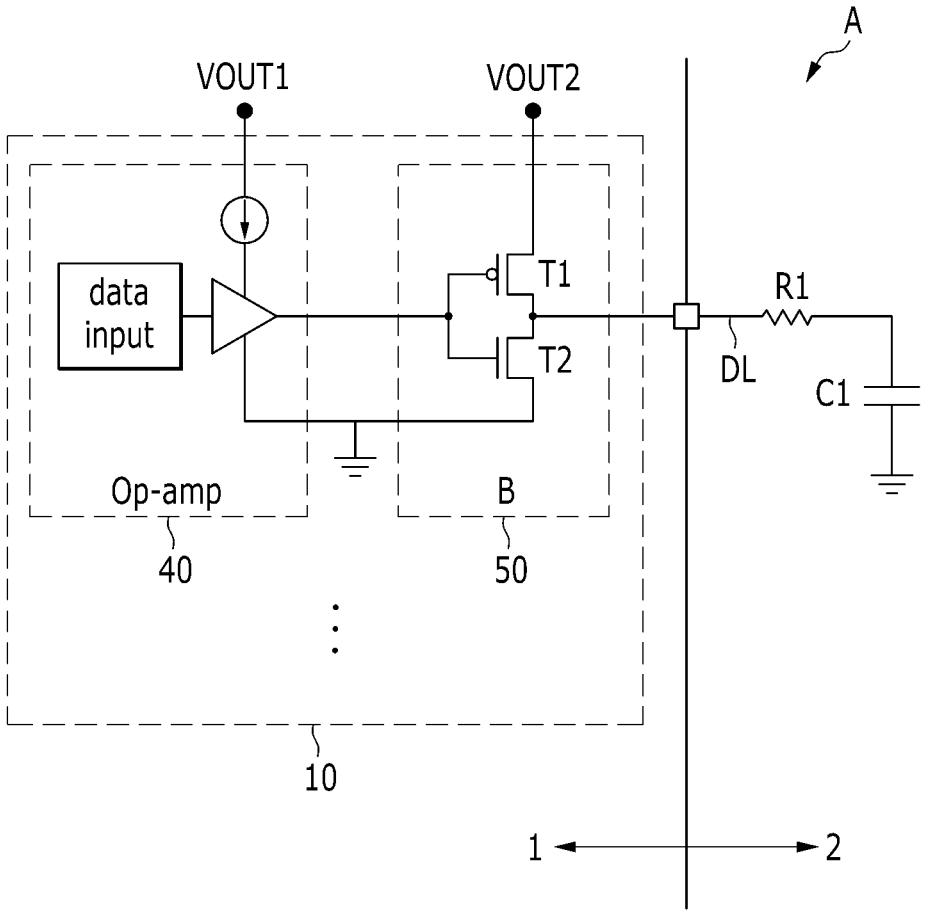
FIG. 2 is an enlarged circuit diagram of "A" in the power supply of FIG. 1.

The portion "A" of FIG. 1, formed of the Op-amp 40 of the amplification circuit and the buffer 50 of the output buffer in the source output circuit 10 of the driving circuit 1 is illustrated in detail in FIG. 2. The portion "A" includes a part of the source output circuit 10 included in the driving circuit 1 and a data line DL of the display panel 2 configured to receive a data voltage output from the source output circuit 10. That is, in FIG. 2, the buffer 50 generating and transmitting an output data voltage according to an input data signal is connected with a resistor R1 and a capacitor C1 of the data line DL through an output terminal.

Each data line DL of the display panel 2 is provided with the corresponding resistor and capacitor, and charges the capacitor by receiving an output data voltage corresponding to an input signal through each data line DL.

In further detail, the Op-amp 40 is connected between a source of the output voltage VOUT1 supplied to the amplification circuit and a ground potential, and receives a voltage according to an input image data signal (i.e., data input) corresponding to each data line and transmits a predetermined output voltage to the buffer 50.

The buffer 50 is formed of a PMOS transistor T1 and an NMOS transistor T2 coupled in series between the source of the output voltage VOUT2 and the ground potential. The output voltage generated from the Op-amp 40 is applied to gate electrodes of each of the PMOS transistor T1 and the NMOS transistor T2.

Since implementation of the circuit driving method of FIG. 2 employs a driving method that displays by inputting digital gray data, when the output voltage is a predetermined gate-on voltage level of the PMOS transistor T1, the PMOS transistor T1 is turned on and thus a high-potential output voltage VOUT2 is applied to the data line DL as an output data voltage. Unlike this, when the output voltage is a predetermined gate-on voltage level of the NMOS transistor T2, the NMOS transistor T2 is turned on and thus a ground voltage is applied to the data line DL as the output data voltage. In the exemplary embodiment of FIG. 2, one end of the Op-amp 40 and one end of the buffer 50 are connected to the ground potential, but it is not restrictive. They may be connected to a low-potential voltage source.

Figure 3:
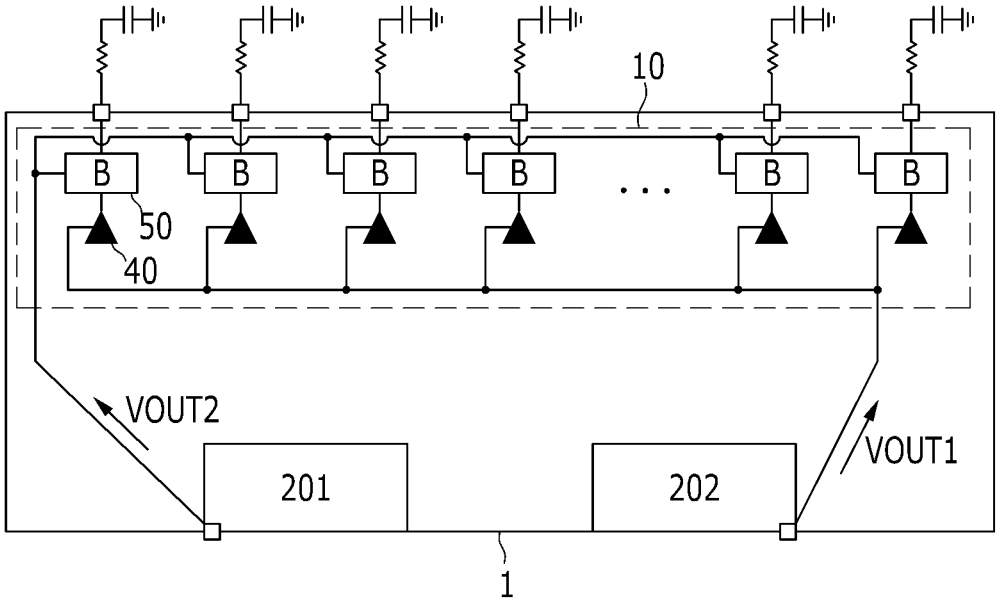
FIG. 3, FIG. 4, and FIG. 5 show a power supply in a driving circuit of a display device according to another exemplary embodiment of the present invention.
Figure 4:
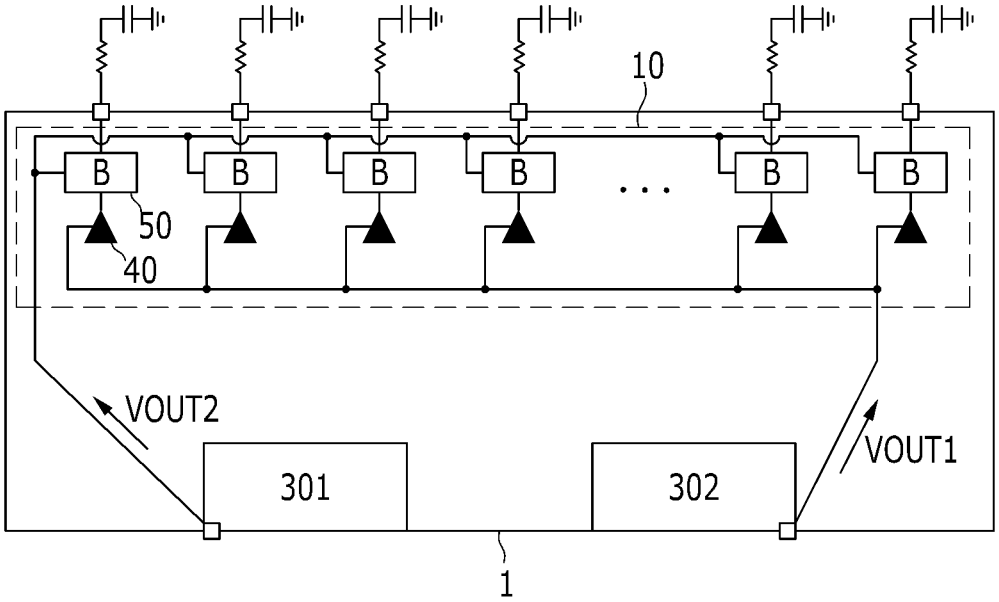
Figure 5:
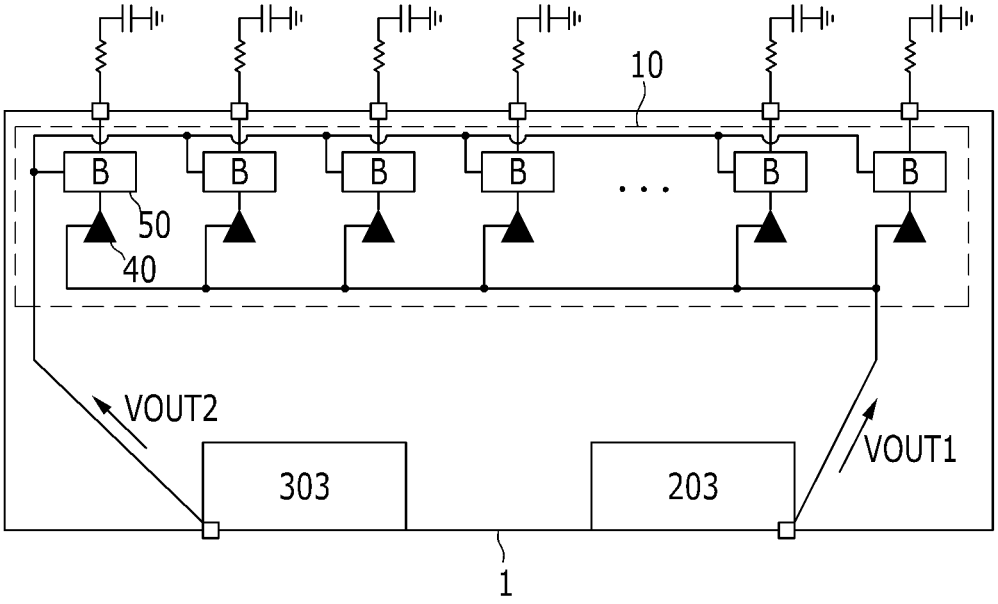

FIG. 3, FIG. 4, and FIG. 5 show power supplies in a driving circuit of a display device according to other exemplary embodiments of the present invention.

The power supply of FIG. 3 has the same configuration as the power supply of FIG. 1 except that the power supply installed in a driving circuit 1 is formed of two capacitive boosts. That is, the power supply according to the exemplary embodiment of FIG. 3 includes a first capacitive boost 201 and a second capacitive boost 202.

In addition, an output voltage VOUT1 supplied to an amplification circuit of a source output circuit 10 is generated in the second capacitive booster 202, and an output voltage VOUT2 supplied to an output buffer of the source output circuit 10 is generated in the first capacitive booster 201.

A power supply of FIG. 4 has the same configuration as the power supply of FIG. 1 except that the power supply installed in a driving circuit 1 may be formed of two inductive boosters. That is, the power supply according to the exemplary embodiment of FIG. 4 includes a first inductive booster 301 and a second inductive booster 302.

In addition, an output voltage VOUT1 supplied to an amplification circuit of a source output circuit 10 is generated in the second inductive booster 302, and an output voltage VOUT2 supplied to an output buffer is generated in the first inductive booster 301.

That is, the power supply according to the exemplary embodiment of FIG. 5 includes an inductive booster 303 and a capacitive booster 203. The capacitive booster 203 generates an output voltage VOUT1 and supplies the output voltage VOUT1 to each Op-amp 40 of an amplification circuit of a source output circuit 10. In addition, the inductive booster 303 generates an output voltage VOUT2 and supplies the output voltage VOUT2 to each buffer 50 of an output buffer of the source output circuit 10.

In general, an inductive booster is more expensive than a capacitive booster, and therefore a booster provided to each part of the source output circuit may be variously combined as in the exemplary embodiments of the power supplies of FIG. 1, FIG. 3, FIG. 3, FIG. 4, and FIG. 5.

By using the power supply according to exemplary embodiments of the present invention, the primary booster output voltage can be stably supplied in a high-resolution display device that requires high power consumption, and a power supply circuit and a driving circuit can be integrally formed because an external power supply is not required.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, those skilled in the art will understand that various modifications and equivalent other embodiments of the present invention are possible. Those skilled in the art can omit some of the constituent elements described in the present specification without deterioration is in performance thereof or can add constituent elements to improve performance thereof. Furthermore, those skilled in the art can modify the sequence of the steps of the method described in the present specification depending on the process environment or equipment. Therefore, the scope of the present invention must be determined by the scope of the claims and the equivalent, not by the described embodiments.

The invention claimed is:

1. A power supply of a display device comprising a driving circuit and a display panel configured to display an image according to an output data voltage transmitted from the driving circuit, wherein:

the power supply comprises a first booster and a second booster disposed in the driving circuit;

the first booster is configured to generate a first output voltage, the first output voltage to be supplied to an Op-amp of a source output circuit of the driving circuit;

the second booster is configured to generate a second output voltage, the second output voltage to be supplied to a buffer of the source output circuit of the driving circuit; and the first output voltage is greater than the second output voltage.

2. The power supply of claim 1, wherein the first booster and the second booster are inductive boosters.

3. The power supply of claim 2, wherein the inductive booster comprises at least one inductor, a diode, a transistor, and an output terminal capacitor, the inductive booster configured to store energy, according to a current supplied through the inductor, in the output terminal capacitor according to a switching operation of the transistor.

4. The power supply of claim 1, wherein the first booster and the second booster are capacitive boosters.

5. The power supply of claim 4, wherein the capacitive booster comprises at least two booster capacitors and an output terminal capacitor, the output terminal capacitor being configured to store an output voltage boosted by the two booster capacitors.

6. The power supply of claim 1, wherein the first booster or the second booster is an inductive booster, and the inductive booster comprises at least one inductor, a diode, a transistor, and an output terminal capacitor.

7. The power supply of claim 1, wherein the first booster or the second booster is a capacitive booster, and the capacitive booster comprises at least two booster capacitors and an output terminal capacitor.

8. The display device of claim 1, wherein the buffer is disposed between the display panel and the Op-amp.

9. The power supply of claim 1, wherein the first booster is configured to simultaneously supply the first output voltage to a plurality of Op-amps in the source output circuit, the plurality of Op-amps being respectively connected to a plurality of data lines in the display panel.

10. The power supply of claim 1, wherein the second booster is configured to simultaneously supply the second output voltage to a plurality of buffers in the source output circuit, the plurality of buffers being respectively connected to a plurality of data lines in the display panel.

11. An apparatus, comprising:

a display panel configured to display an image according to an output data voltage transmitted from a driving circuit; and a power supply circuit comprising:

a first circuit configured to receive a first voltage and output a second voltage; and a second circuit configured to receive a third voltage and output a fourth voltage different from the second voltage, wherein the driving circuit comprises:

a first part configured to receive the second voltage, and to output a fifth voltage; and a second part configured to receive the fourth voltage and the fifth voltage, and to selectively output the fourth voltage according to the fifth voltage, wherein the power supply circuit and the driving circuit are integrally formed, and wherein the second part is disposed between the display panel and the first part.

12. The apparatus of claim 11, wherein a magnitude of the second voltage exceeds a magnitude of the fourth voltage.

13. The apparatus of claim 12, wherein a magnitude of the first voltage equals a magnitude of the third voltage.

14. The apparatus of claim 12, wherein the first circuit comprises a first booster, the second circuit comprises a second booster, the first part of the driving circuit comprises an operational amplifier, and the second part of the driving circuit comprises a buffer.

15. The apparatus of claim 14, wherein the first booster is an inductive booster, the inductive booster being configured to simultaneously supply the second voltage to a plurality of operational amplifiers of the first part of the driving circuit.

16. The apparatus of claim 15, wherein the second booster is either a capacitive booster or an inductive booster.

17. The apparatus of claim 14, wherein the first booster is a capacitive booster, the capacitive booster being configured to simultaneously supply the second voltage to a plurality of operational amplifiers of the first part of the driving circuit.

18. The apparatus of claim 17, wherein the second booster is either a capacitive booster or an inductive booster.

* * * * *